US005730488A

United States Patent [19]

Chang

[11] Patent Number: 5,730,488

[45] Date of Patent: Mar. 24, 1998

[54] PORTABLE FOLDING CHAIR

[75] Inventor: Tony Wei-Sin Chang, San Jose, Calif.

[73] Assignee: Variety International, Inc., San Jose, Calif.

[21] Appl. No.: 789,555

[22] Filed: Jan. 27, 1997

[51] Int. Cl.[6] ..... A47C 4/28

[52] U.S. Cl. ..... 297/45; 297/44; 297/16.1

[58] Field of Search ..... 297/45, 42, 41, 297/44, 51, 52, 16.1

[56] References Cited

U.S. PATENT DOCUMENTS

| | | | |
|---|---|---|---|
| 2,959,212 | 11/1960 | Bauer | 297/45 |
| 3,228,724 | 1/1966 | Risar | 297/45 |
| 3,331,629 | 7/1967 | Munson et al. | 297/45 |
| 4,105,244 | 8/1978 | Colby | 297/45 |
| 4,801,176 | 1/1989 | Wolberg | 297/44 |
| 5,058,949 | 10/1991 | von Hoffman | 297/45 |
| 5,415,455 | 5/1995 | Geldbaugh | 297/45 |
| 5,507,548 | 4/1996 | Marhefka | 297/45 |

*Primary Examiner*—Laurie K. Cranmer
*Attorney, Agent, or Firm*—Jason Z. Lin

[57] ABSTRACT

A folding chair having cylindrical devices for supporting the back-support part of the chair. The folding chair comprises a seat-base part having a seat cloth and two loop-shaped frames pivotedly connected to each other and two joint members each having two extended arms for hingedly connecting the back-support part to the seat-base part. The back-support part includes a back cloth and two supporting tubes. A cylindrical device having a concave surface with two slightly protruded edges on one end is plugged and locked into the bottom opening of each of said supporting tubes. The supporting tubes sit firmly on the upper sections of the frames of the seat-base part by means of matched surface curvature when the back-support part is hingedly opened.

8 Claims, 7 Drawing Sheets

PORTABLE FOLDING CHAIR

FIELD OF THE INVENTION

The present invention relates to a portable folding chair, and more specifically to an enforced structure of a portable folding chair and the manufacture of the same.

BACKGROUND OF THE INVENTION

Portable folding chairs are very popular in recent years. People who love outdoor activities such as camping and watching outdoor sport games usually carry portable folding chairs with them. In order to make chairs foldable and easy to carry around, using a simple chair structure and light weight material is almost inevitable in manufacturing them.

FIG. 1 shows a conventional portable folding chair that is designed to have both simple structure and light weight. The folding chair comprises a seat-base part, a back-support part and a pair of joint members 12. The seat-base part includes a seat cloth 101 and a pair of loop-shaped frames 102 made of light weight tubes. The two loop-shaped frames are substantially identical and pivotedly connected to each other by two pivot pins 103 so that they can be opened or closed. The seat cloth 101 comprises a piece of fabric material affixed to the two loop-shaped frames 102 and holding them together. When the two loop-shaped frames 102 are opened pivotedly, the cloth is unfolded flat and providing a seat for a person. When the frames 102 are in a closed position, the cloth is folded.

The back-support part includes a back cloth 111 and a pair of supporting tubes 112. The back cloth is also made of a piece of cloth having two ends fastened and affixed to the two supporting tubes 112 as shown in FIG. 1. The joint members 12, each being mounted on one of the two supporting tubes, connect the back-support and seat-base parts of the chair together. Each joint member 12 has a respective pair of extended flat arms. Each supporting tube is hingedly connected to one of the loop-shaped frames 102 by a pivot pin 121 passing through the ends of the two flat arms and the frame tube fitted in between. By means of the joint members 12, the two supporting tubes 112 can be held up to make the back-support part stand vertically. If the two loop-shaped frames are then opened, the back cloth is also unfolded to form a back support for a person. By holding the two supporting tubes 112 down, the folding chair can be folded in a very compact form for carrying around.

The conventional folding chair as described above has a drawback in that the back-support part including the two supporting tubes 112 is essentially held vertically only by the joint members 12 when the chair is in an opened position for sitting. The lower end of the supporting tube 112 usually contains a cap 113 plugged therein to seal the tube. FIG. 2 shows the detailed structure of the joint member assembly. Although the supporting tubes 112 may contact and stand on the loop-shaped frames 102 of the seat-base part, they are virtually free to wiggle except for the constraint form the joint members 12. When a person sits on the chair, significant body weight falls on the back-support part and is transmitted to the joint member 12. Therefore, the joint members are easily twisted and deformed if the person moves or changes his sitting position. The life of the folding chair is often very short because of the damage in the joint members 12.

SUMMARY OF THE INVENTION

The present invention has been made to overcome the above mentioned drawback of a conventional folding chair.

The primary object of this invention is to provide an improved structure of a folding chair for extending the usable life of the chair. A second abject is to provide an improved folding chair structure that can be easily manufactured.

The folding chair of the present invention has a seat-base part and a back-support part similar to those of the conventional folding chair, and two joint members with improved structure. According to this invention, cylindrical devices are inserted and affixed in the lower end of the supporting tubes of the back-support part. The cylindrical device has one end protruding out of the tube with a concave surface having a curvature substantially identical to the surface curvature of the loop-shaped frame tubes of the seat-base part of the folding chair.

Joint members, being mounted on the supporting tubes, hingedly connect the back-support part to the seat-base part for the folding chair. The cylindrical devices are affixed to the supporting tubes while the joint members are mounted. When the back-support part is held vertically up, the supporting tubes are made sitting on the loop-shaped frame tubes by means of the cylindrical devices.

To enhance the strength of the joint members, the extended flat arms that are used to hold and connect the loop-shaped frame tubes of the chair are also improved. The flat arms are manufactured in such a way that each arm has a respective part with extruded surface. The strength of the flat arm is increased due to the uneven surface.

The cylindrical devices of this invention provide a mechanism by which the body weight of a person falls on the back-support part of the folding chair will be distributed both on the loop-shaped frame tubes and the joint members. The stress and the pressure falling on the joint members are, therefore, greatly reduced. The improved structure of the flat arms also increases the strength of the joint members. The joint members installed on the folding chair of this invention are not easily deformed because of the enhanced strength and the assistance of the cylindrical devices. The usable life of the folding chair is significantly extended.

DETAILED DESCRIPTION OF THE PREFERRED EMBODIMENTS

Figure 1:
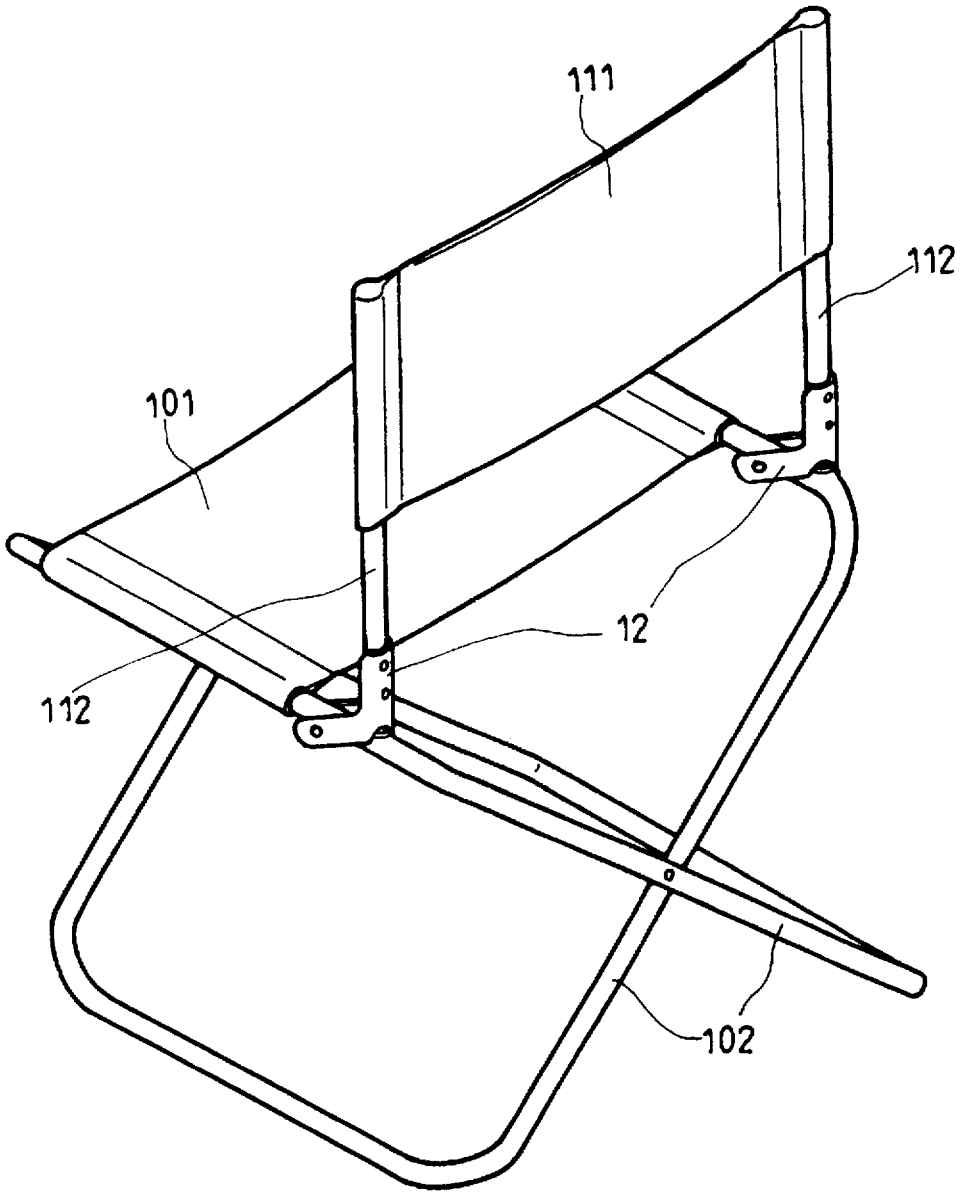
PRIOR ART FIG.1
FIG. 1 shows a perspective view of a conventional portable folding chair.
Figure 2:
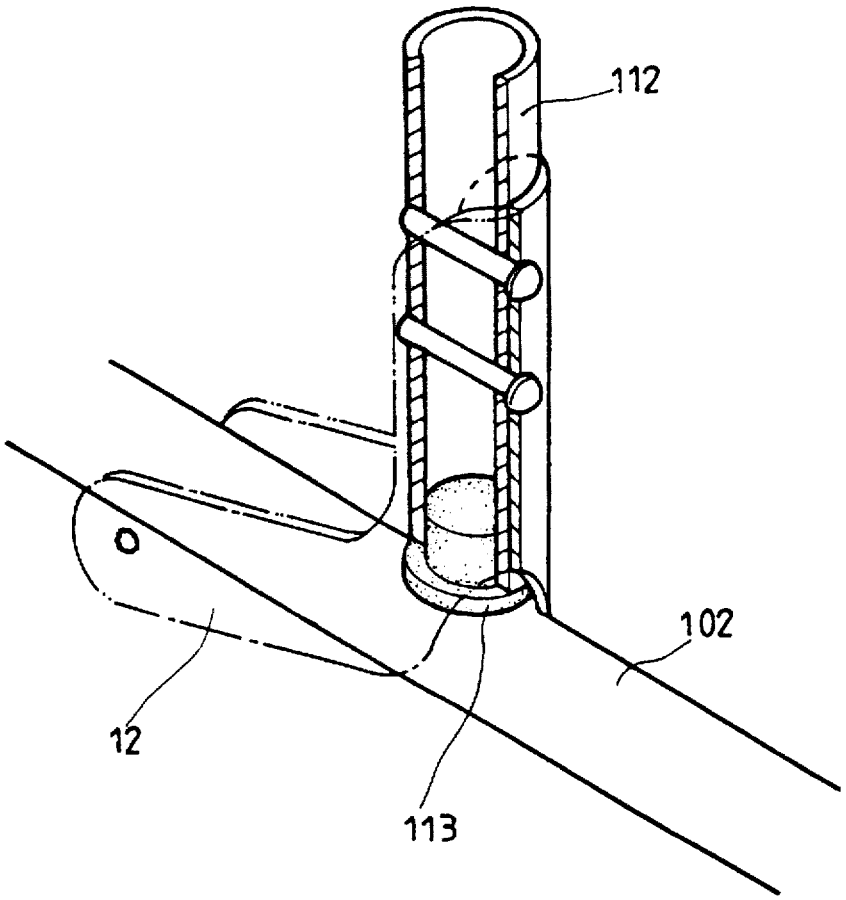
FIG. 2 PRIOR ART
FIG. 2 shows the detailed structure in the joint member assembly of the conventional portable folding chair shown in FIG. 1.
Figure 3:
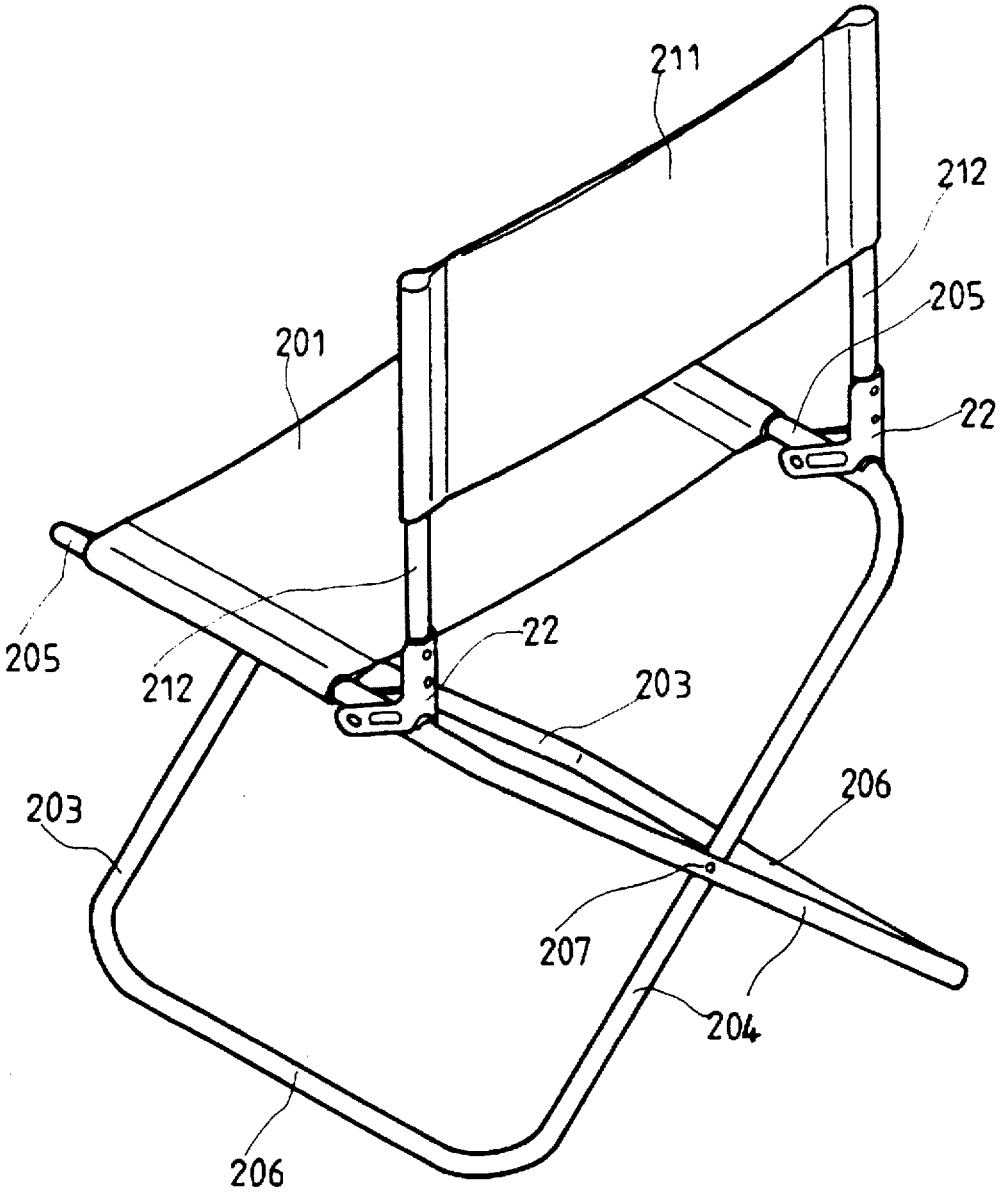
FIG. 3 shows a perspective view of the portable folding chair of this invention.

With reference to FIG. 3, the folding chair of the present invention comprises a seat-base part, a back-support part and a pair of joint members 22. The seat-base part includes a seat cloth 201 and a pair of loop-shaped frames. Each loop-shaped frame, being made of a light weight tube such as a plastic or metallic tube, forms a substantially rectangular loop as shown in FIG. 3. Each loop-shaped frame includes a front section 203, a rear section 204, an upper section 205 and a lower section 206 linked together.

The two loop-shaped frames are substantially identical and pivotedly connected to each other by means of a pivot pin 207 passing through the respective front sections 203 of the two frames and another pivot pin 207 passing through the respective rear sections 204. The pivot pins are positioned substantially in the middle of the front and rear sections respectively. Washers may be inserted between the two frames while pivot pins connect the frames together to ensure that they can be opened and closed smoothly.

The seat cloth 201 comprises a piece of fabric or other plastic or vinyl material strong enough to support a person. The two ends of the seat cloth hold and connect the respective upper sections 205 of the two loop-shaped frames. Each of the two cloth ends may be folded around a respective upper section 205 and then sewn back to the seat cloth to enclose the upper section 205. It may also be simply affixed to the upper section 205 by appropriate fastening devices. When the two frames are opened pivotedly, the seat cloth 201 is unfolded flat, providing a seat. When the frames are in a closed position, the seat 201 cloth is folded.

Figure 4:
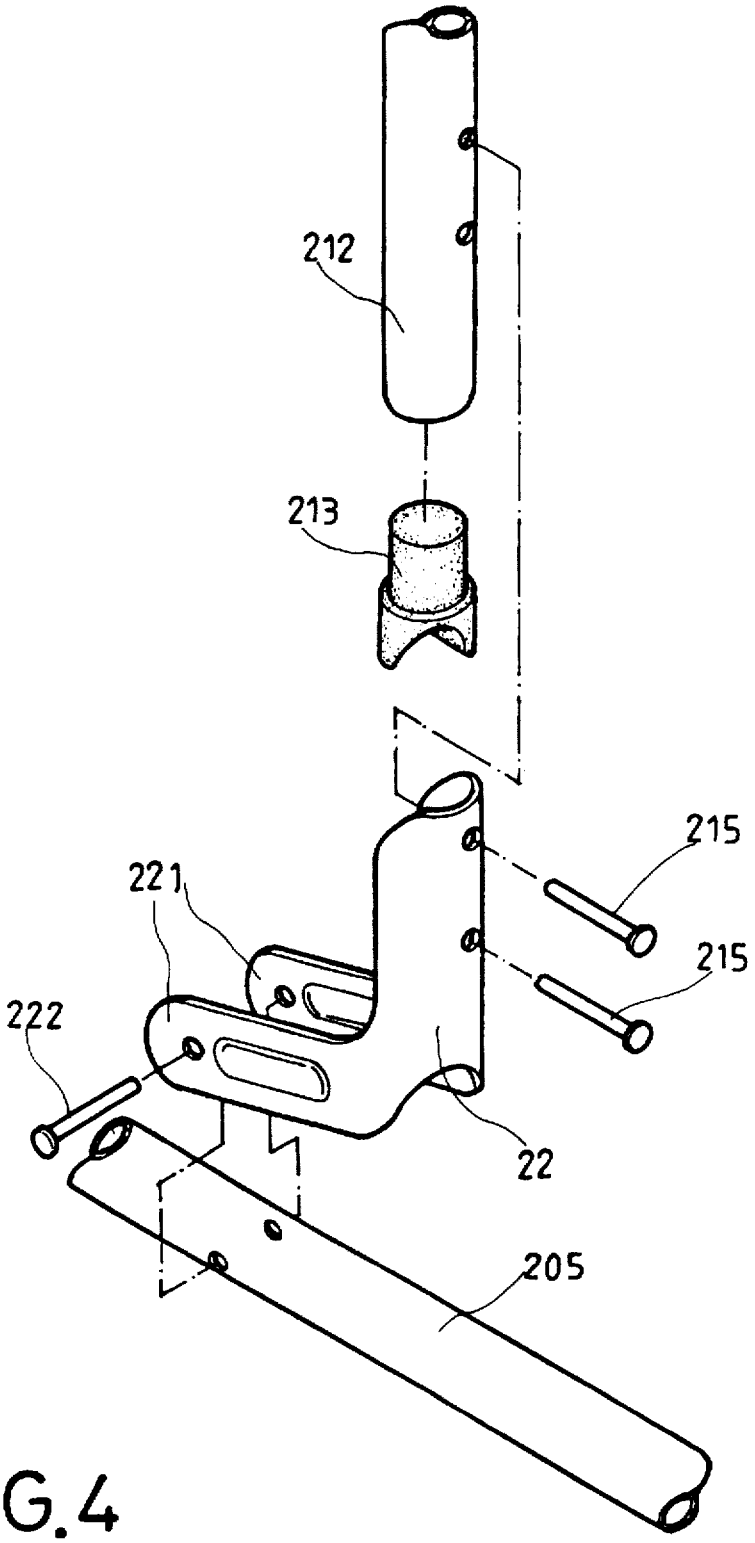
FIG. 4 shows the decomposed view of a preferred embodiment of the joint member assembly of the portable folding chair of this invention.

The back-support part includes a back cloth 211 and a pair of supporting tubes 212. The back cloth 211 comprises a piece of fabric having two ends affixed to the two supporting tubes 212. The material of the fabric can be similar to that of the seat cloth 201. Cushion material may also be included in the back cloth to increase the comfort of the back support. A cylindrical device 213 is plugged into the bottom opening at the lower end of the supporting tube 212 as shown in FIG. 4. The cross section of the cylindrical device has a diameter approximately identical to the diameter of the inner cross section of the supporting tube 212. The lower end of the cylindrical device has a slightly larger diameter and a concave bottom surface forming two slightly protruded edges. Therefore, the cylindrical device 213 can fit into the supporting tube 212 tightly while the two protruded edges on the lower end are exposed. The curvature of the concave bottom surface matches substantially to the curvature of the tube forming the loop-shaped frame.

Figure 5:
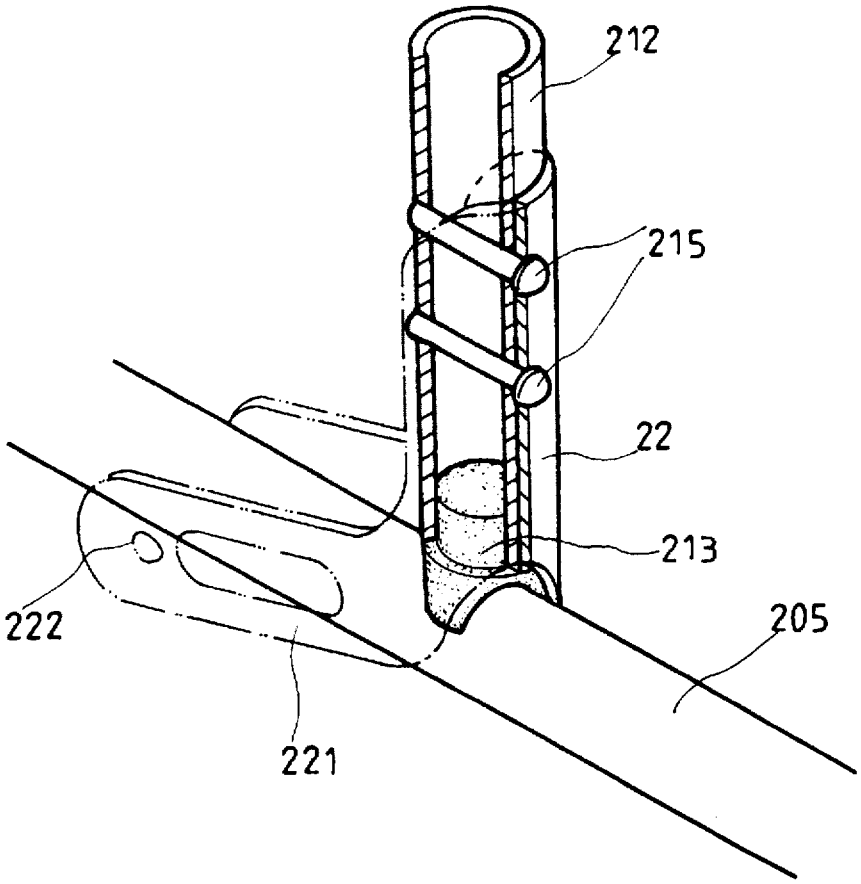
FIG. 5 shows the detailed structure of the joint member assembly as shown in FIG. 4 after being assembled.

The joint members 22 connects the back-support and seat-base parts of the chair together. Each joint member 22, being affixed or mounted to the lower end of the supporting tube 212 by means of two fastening pins 215 or other mounting devices, has a pair of extended flat arms 221. The extended flat arms 221, holding the supporting tube in between and forming an angle with the supporting tube, are aligned substantially in parallel with the two protruded edges of the cylindrical device and then hingedly connected to the upper section 205 of a loop-shaped frame at the end of the arms by a pivot pin 222. FIG. 4 shows the decomposed structure of the joint member assembly. The detailed structure of the joint member assembly after being assembled are also illustrated in FIG. 5.

The angle between the extended arms and the respective supporting tube and the connection of the arms to the loop-shaped frame are designed in such a way that the supporting tube 212 can be hingedly held up. The pivot pin 222 passes through holes near the ends of the two extended arms and a hole on the upper section 205 near the rear end of the section. The cylindrical device is tightly inserted into the supporting tube. When the supporting tube is held up, the protruded part of the cylindrical device sits firmly on the upper section of the loop-shaped frame because the surface curvature matches with that of the tube forming the looped-shaped frame.

By means of the joint members 22 and the cylindrical devices, the back-support part including the back cloth 211 and the supporting tubes can be held up hingedly and fully supported by the upper sections of the loop-shaped frames. If the two loop-shaped frames are then opened, the back cloth 211 is also opened to form a very stable back support for a person. By hingedly closing the back-support part down, the folding chair can be folded in a very compact form for easily carrying around. The joint members are typically made of metallic material having enough strength to hold the back-support part for supporting a person. To increase the supporting strength of the joint member, each extended arm is manufactured with a portion of the arm having extruded uneven surface.

As described above, the back-support part of the folding chair of this invention is fully supported by the upper sections 205 of the loop-shaped frames of the seat-base part when the chair is in an opened position for sitting. The body weight of a person falls on the back-support part is distributed both on the supporting tubes and the joint members 22. In addition, the supporting tubes 212 sitting on the upper sections 205 of the loop-shaped frames are not free to wiggle. The twist and the stress that the joint members have to stand are significantly reduced. The improved structure on the extended arms of the joint members further strengthens the joint members. The usable life of the folding chair is greatly increased because the joint members are not easily deformed or damaged.

Figure 6:
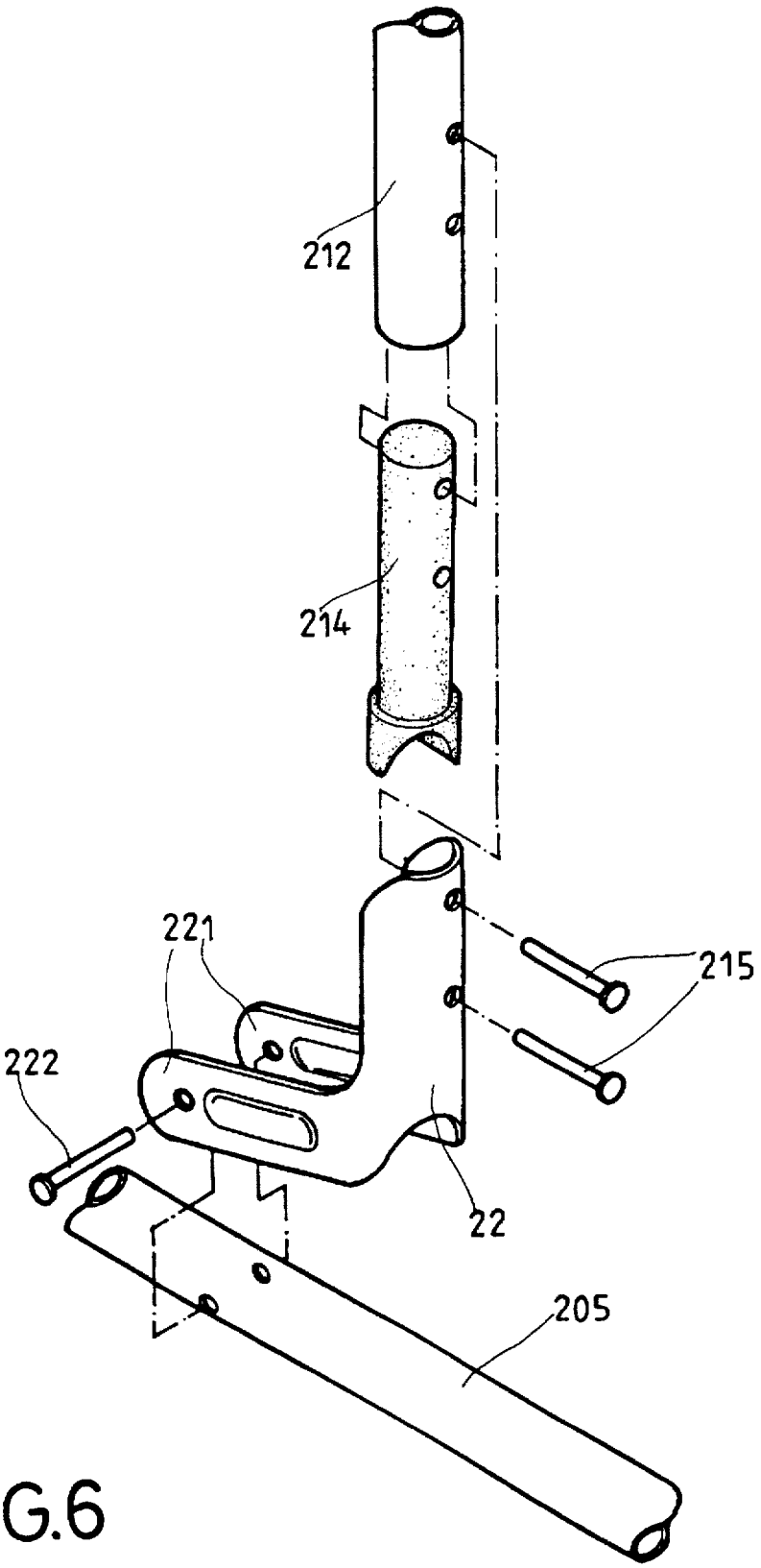
FIG. 6 shows the decomposed view of an alternative embodiment of the joint member assembly of the portable folding chair of this invention.
Figure 7:
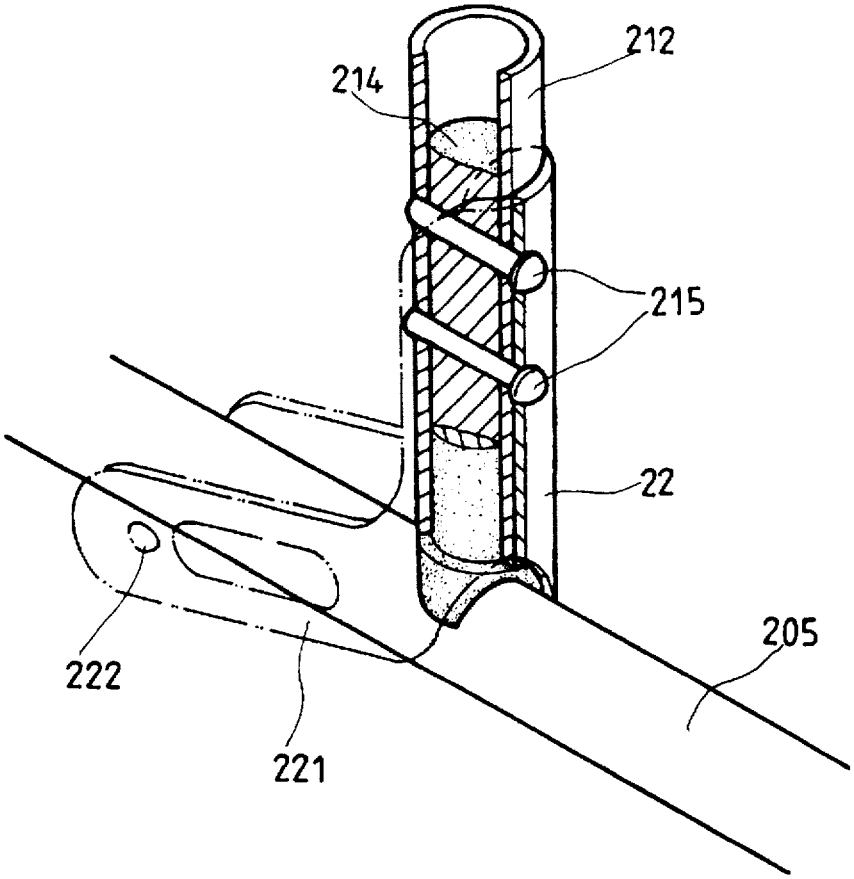
FIG. 7 shows the detailed structure of the joint member assembly as shown in FIG. 6 after being assembled.

A decomposed view of an alternative embodiment of the joint member assembly is shown in FIG. 6. The joint member assembly is essentially identical to the one shown in FIG. 4 except that the cylindrical device 214 is longer. Because of the extra length, the cylindrical device 214 can also be affixed to the supporting tubes 212 by means of two pins 215 along with the joint member 22. Two holes have to be drilled through the cylindrical device 214 for passing the pins 215. The detailed structure of the joint member assembly of FIG. 6 after being assembled is shown in FIG. 7.

The seat cloth and the back cloth as disclosed in this invention can be replaced by a plurality of pieces of cloth for serving equivalent functions. The material of the seat or back cloth can be fabric, vinyl or other plastic material having enough strength to support the weight of a person. The cylindrical device can be made of plastic, nylon or ABS (acrylo-mitrile butadiene-styrene) material. Other embodiments of this invention may also be modified by a person skilled in the field based on the disclosed principle. Although only the preferred embodiments of this invention were shown and described in the above description, it is requested that any modification or combination that comes within the spirit of this invention be protected.

What is claimed is:

1. A folding chair comprising:

a seat-base part including a seat cloth and two substantially identical loop-shaped frames, each of said frames being substantially rectangular and having a front tube section, a rear tube section, an upper tube section and a lower tube section, said seat cloth having two ends holding the two upper sections, and said two frames being pivotedly connected to each other by means of a first pivot pin connecting the two front tube sections and a second pivot pin connecting the two rear tube sections;

a back-support part including a back cloth and two supporting tubes, each of said supporting tubes having a bottom opening at a lower end, said back cloth having two ends holding said two supporting tubes;

two cylindrical devices each having an upper part with a diameter approximately equal to the diameter of the inner cross-section of said supporting tubes, and a lower part with a diameter slightly larger than the upper part diameter and a concave bottom surface forming two slightly protruded edges, said concave surface having a curvature substantially matching the curvature of the cross-section of said upper tube section, and each of said devices being plugged and locked into the bottom opening of one of said supporting tubes leaving said lower part exposed, said lower part sitting firmly on said upper tube section when said supporting tubes are held up; and two joint members each being affixed and locked on one of said supporting tubes near the bottom openings, each of said joint members having two extended arms aligned substantially in parallel with said protruded edges of said cylindrical device and said two extended arms having one of said supporting tubes in between, forming an angle with the supporting tube and being hingedly connected to said upper tube section of one of said frames near the rear tube section;

wherein said back-support part can be held up by hingedly opening said joint members for holding said supporting tubes substantially vertical and said seat-base part can be opened pivotedly for unfolding said seat cloth for providing a seat, and the body weight of a person that falls on said back-support is distributed both on said supporting tubes and said joint members.

2. The folding chair according to claim 1, wherein each of said extended arms of said joint members further comprises a portion of the arm having uneven surface.

3. The folding chair according to claim 1, wherein said loop-shaped frames and said supporting tubes are made of metallic tubes having substantial strength for supporting the weight of a person.

4. The folding chair according to claim 1, wherein said loop-shaped frames and said supporting tubes are made of plastic tubes having substantial strength for supporting the weight of a person.

5. The folding chair according to claim 1, wherein said seat cloth and said back cloth are made of fabric having substantial strength for supporting the weight of a person.

6. The folding chair according to claim 1, wherein said seat cloth and said back cloth are made of vinyl having substantial strength for supporting the weight of a person.

7. The folding chair according to claim 1, wherein said seat cloth and said back cloth are made of plastic material having substantial strength for supporting the weight of a person.

8. The folding chair according to claim 1, wherein said cylindrical devices are made of plastic, nylon or ABS material.

* * * * *